United States Patent [19]

Yashima

[11] 4,295,758

[45] Oct. 20, 1981

[54] WORKING PLATFORM FOR OIL DRILLING OPERATIONS IN ICE COVERED SEA AREAS

[75] Inventor: Nobuyoshi Yashima, Funabashi, Japan

[73] Assignee: Mitsui Engineering and Shipbuilding Co., Ltd., Tokyo, Japan

[21] Appl. No.: 97,933

[22] Filed: Nov. 27, 1979

[30] Foreign Application Priority Data

Nov. 30, 1978 [JP] Japan ..... 53-148875
Nov. 30, 1978 [JP] Japan ..... 53-14876

[51] Int. Cl.[3] ..... E02D 17/00

[52] U.S. Cl. ..... 405/201; 405/211; 405/217

[58] Field of Search ..... 405/217, 212, 215, 211, 405/61, 201

[56] References Cited

U.S. PATENT DOCUMENTS

| | | | |
|---|---|---|---|
| 3,952,527 | 4/1976 | Vinieratos et al. | 405/217 |
| 4,068,487 | 1/1978 | Pease et al. | 405/217 X |
| 4,102,144 | 7/1978 | Anders | 405/217 X |
| 4,215,952 | 8/1980 | Baardsen | 405/215 X |

*Primary Examiner*—Price C. Faw, Jr.
*Assistant Examiner*—Carl D. Friedman
*Attorney, Agent, or Firm*—Armstrong, Nikaido, Marmelstein & Kubovcik

[57] ABSTRACT

A working platform for oil drilling operations in ice covered sea areas, which essentially comprises oil drillig equipment, an oil drilling pipe connecting the oil drilling equipment to the sea bottom, and a floating frame having a buoyancy and a strength enough to stand the pressure of an ice covering and being movable in accordance with movement of ice covering; the floating frame is disposed surrounding such a surface area of the ice covered sea as lying around the oil drilling pipe, whereby the pipe is protected by the floating frame against action of the pressure of ice covering during oil drilling operations.

13 Claims, 15 Drawing Figures

WORKING PLATFORM FOR OIL DRILLING OPERATIONS IN ICE COVERED SEA AREAS

BACKGROUND OF THE INVENTION

1. Field of the Invention

The present invention relates to oil drilling equipment to be installed in ice covered sea areas and, more particularly, to a working platform for oil drilling operations, which is suitable for comparatively shallow ice covered sea areas.

2. Description of the Prior Art

In an ice covered sea area, for example, the Arctic Ocean, the fast ice is moved by a small distance, or around 20 m at most during the winter months.

In order to conduct an oil drilling operation in such an ice covered sea area of a small depth (of not more than 20 m), a method of installing oil drilling equipment on an artificial island has heretofore been employed, which artificial island is formed with sand or gravel accumulated in the sea area, or the fast ice in the sea area.

However, it is necessary that such an artificial island be formed to large dimensions so that it can stand floating ice running thereon and the pressure of large ice blocks surrounding the same. Such an artificial island can be formed only in a shallow sea area and requires 1–2 months to build. Moreover, it is difficult to remove an artificial island, if it is formed with sand or gravel, after oil drilling operations have been completed. Removing such an artificial island poses problems of environmental pollution.

In order to conduct oil drilling operations on an artificial island, it is also necessary to transport oil drilling equipment and various kinds of materials from a coastal area near the same. This often results in a delay in starting the object operations.

As may be clearly understood from the above, it takes a long period of time to build an artifical island. In addition, the building of such an artificial island incurs a great deal of expense.

SUMMARY OF THE INVENTION

An object of the present invention is to provide a working platform suitable for oil drilling operations in comparatively shallow ice covered sea areas of not more than 20 m in depth.

Another object of the present invention is to provide a working platform for oil drilling operations in ice covered sea areas, which can be formed in a short period of time and which can be removed easily.

Still another object of the present invention is to provide a working platform for oil drilling operation in ice covered sea areas, which causes no environmental pollution.

A further object of the present invention is to provide a working platform for oil drilling operations in ice covered sea areas, which permits conducting an oil drilling operation for a long period of time in all seasons.

To these ends, the present invention provides a working platform for oil drilling operations in ice covered sea areas, which comprises an oil drilling pipe protected in a marine riser or conductor pipe connecting oil drilling equipment to the sea-bottom, a floating frame enclosing the surface of the sea water surrounding the pipe, and a means for heat-insulating the surface of the sea-water inside the floating frame, the working platform being characterized in that the floating frame is strong enough to stand the pressure of ice and movable in accordance with the movements of ice.

The above and other objects as well as advantageous features of the invention will become clear from the following description of preferred embodiments taken in conjunction with the accompanying drawings.

DESCRIPTION OF PREFERRED EMBODIMENTS

Figure 1:
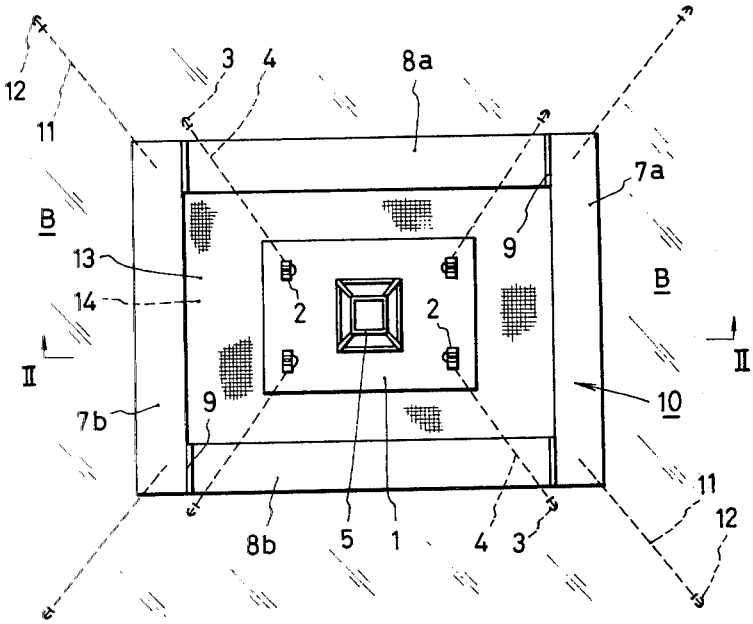
FIG. 1 is a plan view of a first embodiment of a working platform for oil drilling operations in ice covered sea areas according to the present invention.
Figure 2:
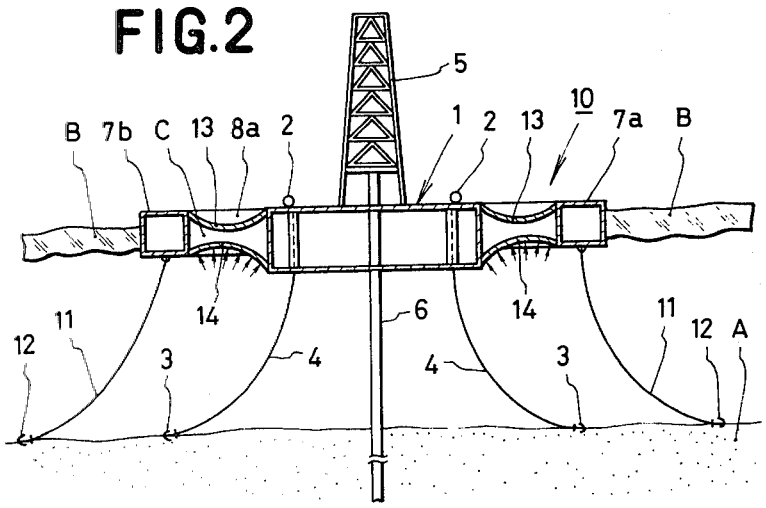
FIG. 2 is a longitudinal sectional view taken along the line II—II in FIG. 1.

FIGS. 1 and 2 show a first embodiment of a working platform for oil drilling operations, which is suitable for ice covered sea areas of a comparatively large depth.

Referring to the drawings, reference numeral 1 denotes a rectangular, floating platform fixed to the sea-bottom A with wires (or chains) 4 wound at one end portion thereof around winches 2 secured to the platform 1 and connected at the other end portion thereof to anchors 3. A tower 5 and drilling machines and tools (not shown) are installed on the platform 1, and a drilling pipe 6 extended from a drilling machine is inserted into the sea-bottom, the drill pipe 6 being protected in a marine riser or conductor pipe.

An ice prevention frame 10 is disposed around the platform 1 such that the frame 10 is spaced from the platform 1. The ice prevention frame 10 consists of floating, iron or concrete frame members 7*a*, 7*b*, 8*a*, 8*b*; joints 9 whereby the frame members 7*a*, 7*b*, 8*a*, 8*b* are detachably connected together around the platform 1; and wires 11 connected to the frame members 7*a*, 7*b*, 8*a*, 8*b* and anchors 12 so as to fix the ice prevention frame 10 to the sea-bottom.

The space between the platform 1 and rectangular ice prevention frame 10 constitutes a buffer zone for preventing ice B from being formed therein. It is necessary to prevent the buffer zone from being freezed.

In order to prevent the buffer zone from being freezed, sheets 13, 14 made of rubber or a synthetic resin are disposed in the buffer zone in a vertically spaced manner to form an air layer C and insulate that portion of the sea-water in the buffer zone which is above the air layer C.

In general, such an air layer alone serves to prevent the surface of the sea-water surrounded by the ice prevention from 10 from being freezed. However, when a mere provision of such an air layer does not produce a sufficient heat-insulating effect, means for supplying warm or hot air into the interior of the air layer C may be provided.

When the air layer C is formed by spaced sheets 13, 14 only, there is the possibility that the sheets 13, 14 cannot be kept spaced from each other by a predetermined distance or that a heat-insulating layer cannot be retained. In such a case, a spacer of a suitable material may be provided between the sheets 13, 14.

When warm or hot air is supplied into the air layer C, such a spacer may be effectively utilized as a kind of a guide vane.

In order to build a working platform of the above-described structure for oil drilling operations in ice covered sea areas, oil drilling equipment is mounted on a platform 1 in a dock or the like, and the resulting product is towed to an object ice covered sea area so as to be fixed to the sea-bottom with wires 4 and anchors 3. At the same time, separately formed frame members *7a, 7b, 8a, 8b* which are produced independently of the platform 1 and oil drilling equipment are towed or transported by ship to the object place. These frame members *7a, 7b, 8a, 8b* are then arranged around the platform 1 and connected together with joints 9 to form an ice prevention frame 10, which are also fixed to the sea-bottom with wires 11 and anchors 12. Sheets 13, 14 are thereafter laid in a vertically spaced manner in a space between the platform 1 and ice prevention frame 10 to cover the same.

The working platform is the most preferably built in the summer season in which the ice melts. However, it can also be built in the winter season, in which the sea-water is freezed, after breaking the ice in a suitable manner if the working platform is of certain dimensions and if the fast ice in the object sea area is of a certain thickness.

A working platform according to the present invention is characterized in that it consists of a platform 1, an ice prevention frame 10 provided around the platform 1 to form a space therebetween, and a pair of vertically spaced sheets 13, 14 laid in the space to form an air layer C which serves as a heat-insulating layer.

In this construction, the sea water inside the ice prevention frame 10 is always kept at a temperature higher than the freezing point so that the sea water in the above-mentioned zone can be prevented from being freezed even in the winter season.

When an oil drilling operation is conducted in the winter season in which fast ice or floating ice B exists around the working platform, the ice prevention frame 10 is moved by the movements of the ice. However, since sheets 13, 14 provided in the space between the ice prevention frame 10 and platform 1 are made of an elastic material, a force exerted to the ice prevention frame 10 is never transmitted to the platform 1. Consequently, no bending stress is applied to various kinds of machines and tools on the platform 1, especially, the drilling pipe 6. In fact, the oil drilling pipe 6 is therefore never bent.

The space between the ice prevention frame 10 and platform 1 constitutes a safety zone whereby the ice prevention frame 10 is prevented from pressing the platform 1 even when the ice B is moved. The area of this safety zone may be determined in view of the amount of movement of the ice (the ice in, for example, the Arctic Ocean, is moved by 20 m during the winter season) and the length of time during which the oil drilling operations are to be conducted (oil drilling operations are conducted usually for 2–3 months).

When the amount of movement of ice and the direction in which the ice is moved are known before a working platform is built, an ice prevention frame 10 may be eccentrically disposed beforehand with respect to the platform 1, taking the above information into consideration. Namely, the ice prevention frame 10 may be put aside beforehand to a side which is opposite to the side toward which the ice prevention frame 10 will be moved. This allows the ice prevention frame 10 to be maintained in a sufficiently safe condition even when the frame 10 is of small dimensions.

When the ice prevention frame 10 is moved, the sheets 13, 14 are bent or expanded. Therefore, it is necessary that the size of each part of the sheets 13, 14 be in a certain range which causes no breakage therein and no decrease in the heat-insulating capability.

Figure 3:
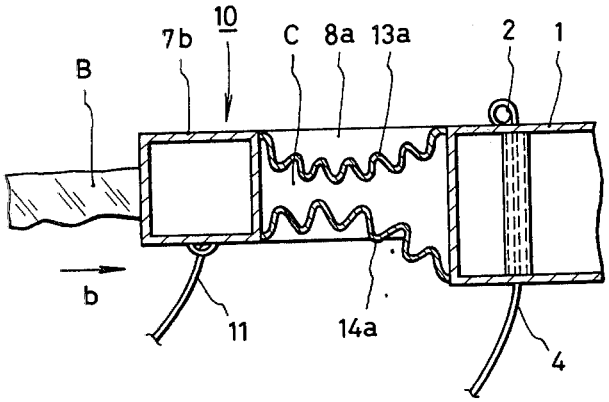
FIG. 3 is an enlarged partial sectional view of an elastic member in a second embodiment of the present invention.

FIG. 3 shows a second embodiment of the present invention. This embodiment has sheets 13, 14 consisting of bellows members 13*a*, 14*a*, whereby the ice prevention frame 10 can be easily moved. The bellows members 13*a*, 14*a* permit easily retaining a space C and preventing the ice prevention frame 10 from being broken.

FIG. 3 shows a principal portion of a second embodiment. Those parts of the second embodiment which are not shown in FIG. 3 may be formed in the same manner as in the first embodiment.

Referring to FIG. 3, the pressure of sea-water is applied to the bellows member 14*a* so that the bellows member 14*a* is projected toward the other bellows member 13*a*. As a result, these bellows members 13*a*, 14*a* contact each other so that the space C is lost completely or partially. This causes a decrease in the heat-insulating effect and the sea water under the bellows member 14 may be freezed. In order to prevent this, it is desirable to provide a suitable spacer between the bellows members 13*a*, 14*a*.

Figure 4:
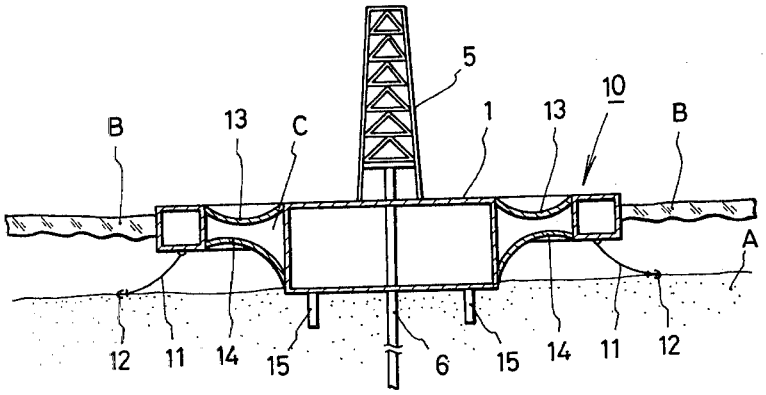
FIG. 4 is a front elevational view in longitudinal section of a third embodiment of the present invention.

FIG. 4 is a front elevational view in longitudinal section of the working platform for conducting oil drilling operations in shallow ice covered sea areas shown in FIG. 3. This working platform has a platform 1 the height of which is determined in accordance with the depth of the water in an object sea area, and a skirt or a projection 15 extended from the bottom portion of the platform 1 and driven into the sea-bottom A to fix the platform 1. In the meantime, an ice prevention frame 10 is floated the surface of the sea water and fixed to the sea-bottom with wires 11 and anchors 12. The elastic elements employed consist of elastic sheets 13, 14 or bellows members 13*a*, 14*a* described previously in connection with the first and second embodiments. Those parts of this third embodiment which are not referred to above are substantially the same as the corresponding parts of the first and second embodiments with respect to the construction, forming method, effect and function.

Figure 5:
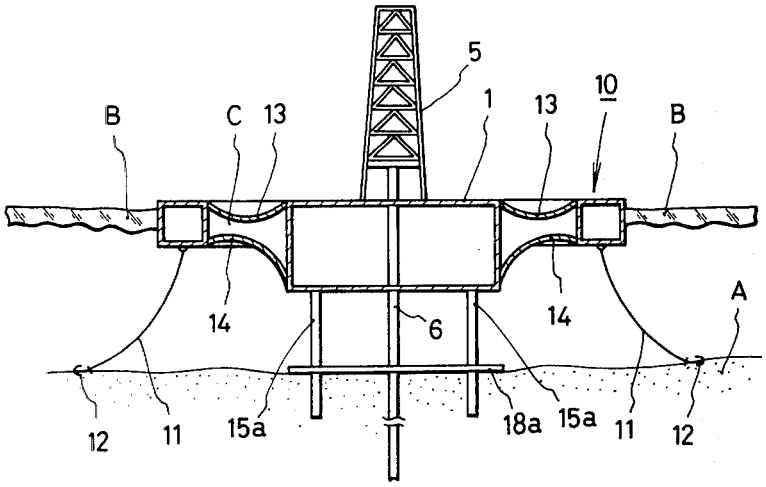
FIG. 5 is a front elevational view in longitudinal section of a fourth embodiment of the present invention.

FIG. 5 shows a fourth embodiment of the present invention. In this embodiment, the skirt or projection 15 in the embodiment shown in FIG. 4 is replaced by posts 18'. The posts 18' is inserted at their lower end portions into the sea-bottom, and provided at their intermediate portions with a support plate 18*a* fixed thereto to thereby support the weight of the platform 17, etc.

Figure 6:
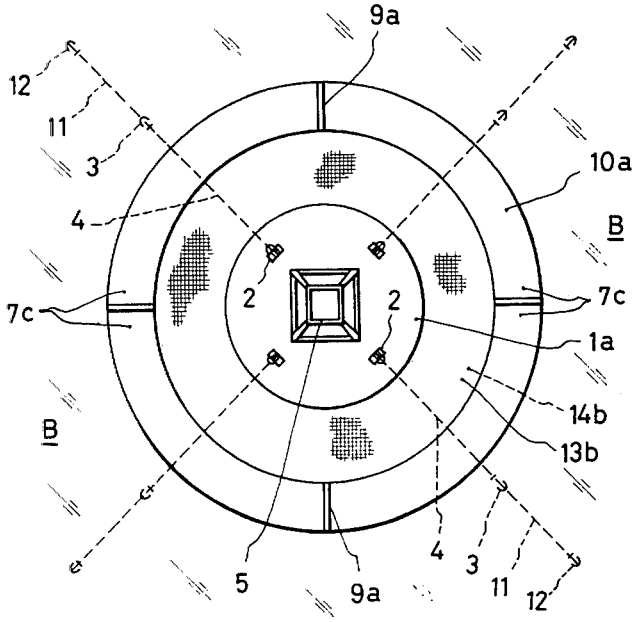
FIG. 6 is a plan view of the embodiment shown in FIG. 5.

FIG. 6 shows a fifth embodiment of the present invention. This embodiment has a circular platform 1*a*, four separate frame members 7*c* connected to one another with joints 9*a* to form, for example, an annular floating ice prevention frame, and vertically spaced sheets 13*b*, 14*b* provided in the space between the platform 1*a* and ice prevention frame 10*a*. The platform 1*a* may be anchored or immovably fixed to the sea-bottom.

In the first to fifth embodiments described above, sheets 13, 14 are provided in a vertically spaced manner in the space between the ice prevention frame 10 and platform 1 to form a space C serving as a heat-insulating layer.

Figure 7:
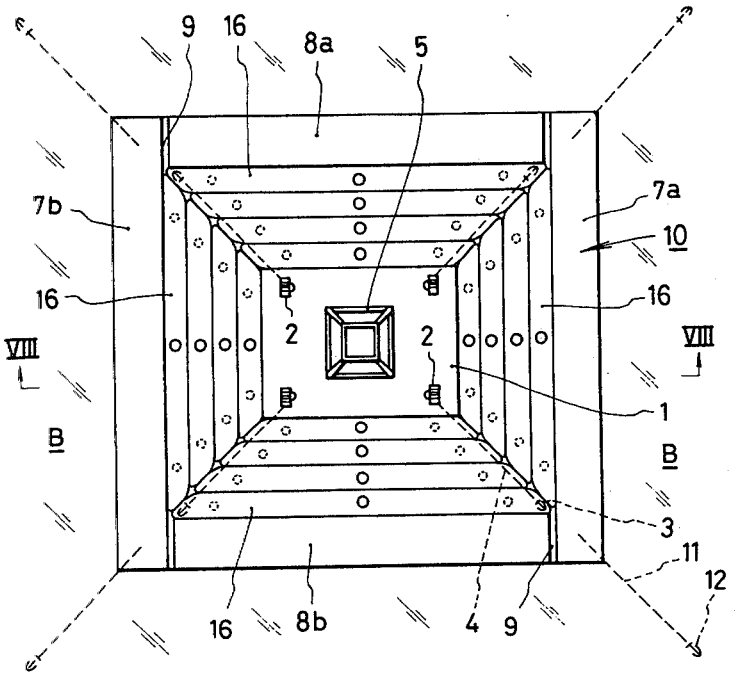
FIG. 7 is a plan view of a sixth embodiment of the present invention.
Figure 8:
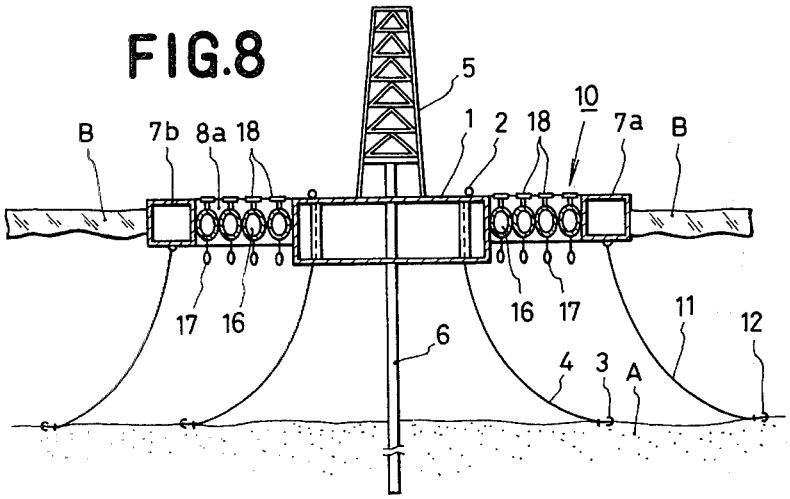
FIG. 8 is a sectional view taken along the line VIII—VIII in FIG. 7.

FIGS. 7 and 8 show a sixth embodiment employing air bags between a platform 1 and an ice prevention frame 10.

In the sixth embodiment, a plurality of bags 16 sealingly filled with air are placed on the surface of the sea-water between the platform 1 and ice prevention frame 10. Each of the air bags 16 has a weight 17 suspended therefrom, and the air bag-lowering force of each of the weights 17 balances the buoyancy of each of the air bags 16. Each of the air bags 16 is further provided with a valve (check valve) 18 for regulating the air pressure therein. Each of the valves 18 is opened when the pressure of the air in the relative air bag exceeds a predetermined level to discharge the air to the outside. A suitable internal pressure is applied to the air bags in an initial stage of installing the oil drilling equipment so that the air bags are deformed or bent to a predetermined extent in a direction parallel to the surface of the sea-water between the outer surface of the platform 1 and the inner surface of the ice prevention frame 10.

Since the surface of the sea-water between the platform 1 and ice prevention frame 10 is thus prevented from being exposed to the atmosphere owing to the air bags 16. Accordingly, the surface of the sea-water in the above-mentioned area is never freezed. Moreover, when a pressing force of ice exerted to the ice prevention frame 10, the frame 10 can be moved without transmitting the pressing force to the platform 10.

The above will be described more in detail. When the ice around the working platform is moved in a certain direction, the air bags outside the platform 1 and on the upstream side of the moving ice are pushed by the ice prevention frame 10. When the pressure in the air bags exceeds a predetermined level, the valves 18 are opened to discharge the air from the air bags. As a result, the air bags 16 are contracted so that the ice prevention frame 10 is moved by a distance equal to the distance by which the ice is moved. Namely, the movement of the ice prevention frame 10 is absorbed by the air bags 6 and not transmitted to the platform 1. At this time, the air bags outside the platform 1 and on the downstream side of the moving ice are expanded parallel to the surface of the sea-water to cover that portion of the surface of the sea-water which is between the platform 1 and ice prevention frame 10 and which has been increased in area due to the movement of the ice prevention frame 10.

Figure 9:
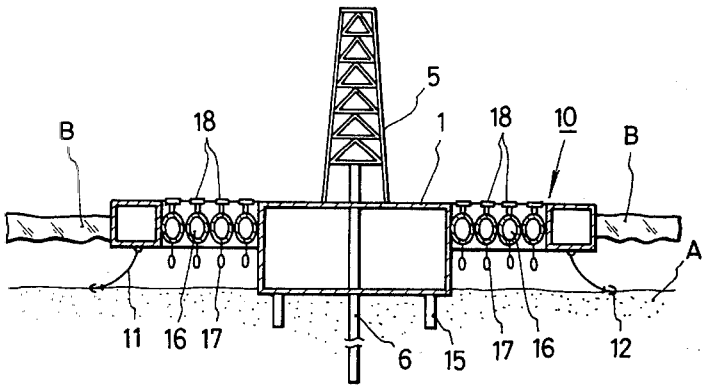
FIG. 9 is a front elevational view in longitudinal section of a seventh embodiment of the present invention.

FIG. 9 shows a seventh embodiment of the present invention. When this embodiment is set in a shallow ice covered sea area, a platform 1 is seated on the sea-bottom and fixed thereon with a skirt 15 driven thereinto.

Figure 10:
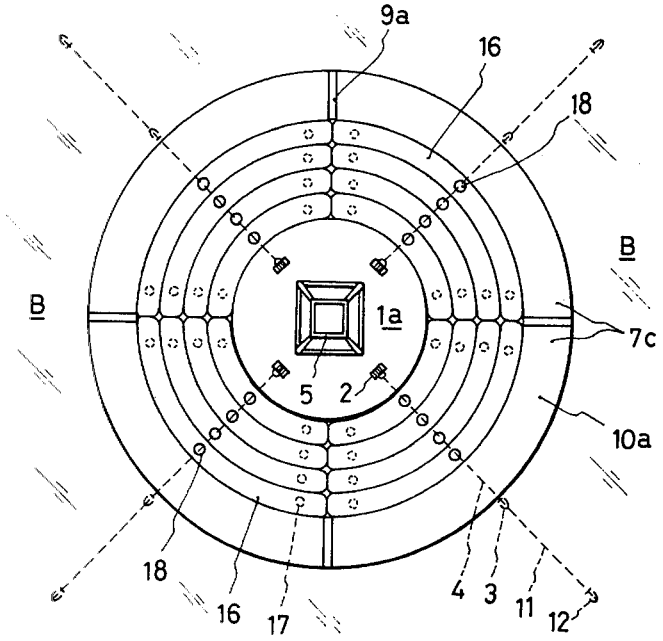
FIG. 10 is a plan view of an eighth embodiment of the present invention.

FIG. 10 shows an eighth embodiment of the present invention having a circular platform 1*a*, a circular ice prevention frame 10*a*, and sausage type air bags disposed between the platform 1*a* and ice prevention frame 10*a*.

The working platforms for oil drilling operations in ice covered sea areas, which are shown in FIGS. 9 and 10 permit producing a buffer effect in the same manner as the embodiments shown in FIGS. 7 and 8, when the surrounding ice is moved.

In the embodiments shown in FIGS. 1–10, a platform having a buoyancy is employed. However, a working platform according to the present invention is not necessarily provided with such a type of platform. Namely, the platforms in the above-mentioned embodiments may be omitted if the ice prevention frame has a sufficiently high buoyancy to support oil drilling equipment.

Embodiments of the present invention having no platform will be described in detail.

Figure 11:
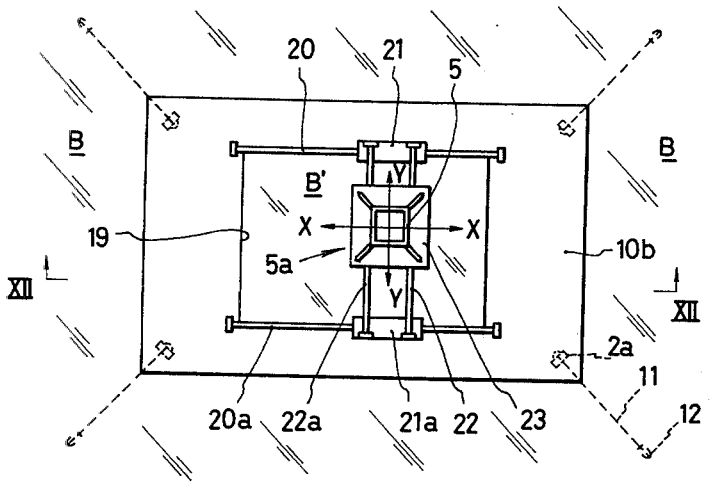
FIG. 11 is a plan view of a ninth embodiment of the present invention.
Figure 12:
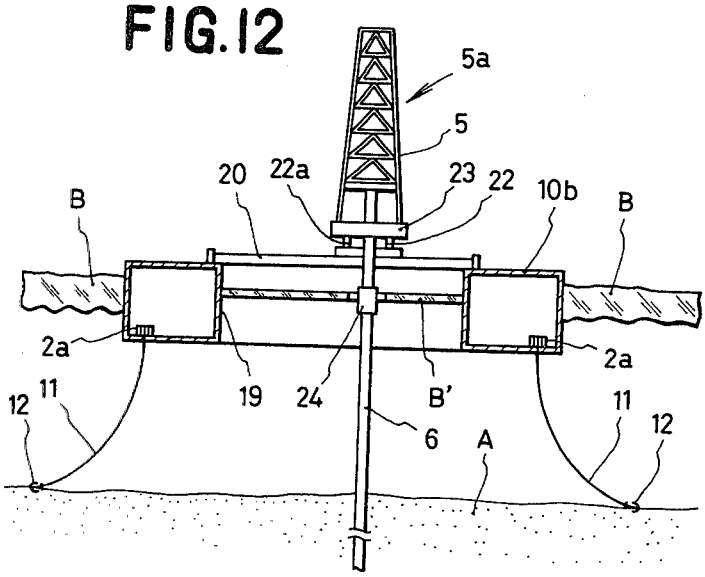
FIG. 12 is a longitudinal sectional view taken along the line XII—XII in FIG. 11.

FIGS. 11 and 12 show a ninth embodiment of the present invention.

In this embodiment, a barge 10*b* is provided, which functions in the same manner as the ice prevention frames in the embodiments shown in FIGS. 1–10 and which is cut out at the central portion thereof.

A pair of parallel first rails 20, 20*a* are fixed to the opposite end portions of a cut-out portion 19 of the barge 10*b*. First carriers 21, 21*a* are provided on the first rails 20, 20*a*, respectively such that the former can be moved along the latter. A pair of parallel second rails 22, 22*a* are fixed to the upper surfaces of the carriers 21, 21*a* such that the second rails 22, 22*a* are at right angles to the first rails 20, 20*a*. A second carrier 23 is provided on the second rails 22, 22*a* such that the former can be moved along the latter. Oil drilling equipment 5*a* consisting of a tower 5 and oil drilling machines and tools (not shown) is mounted. Therefore, the oil drilling equipment 5*a* and second carrier 23 can be reciprocatingly moved along the second rails 22, 22*a* (in the direction designated by a symbol Y). The oil drilling equipment 5*a*, second carrier 23, second rails 22, 22*a*, and first carriers 21, 22 can be reciprocatingly moved together along the first rails 20, 20*a* (in the direction designated by a symbol X).

The barge 10*b*, first and second rails 20, 20*a*, 22, 22*a*, and oil drilling equipment 5*a* are made in a dock beforehand. All of these parts are towed to an object ice covered sea area (they can be used in other kinds of places than ice covered sea areas), where these parts are fixed to the sea-bottom A with wires 11 (or chains) wound up by a winch 2*a*, and anchors 12, to complete the installation of the working platform.

After the working platform has been installed, an oil drilling operation can be started at once while driving an oil drilling pipe 6 into the sea-bottom.

When this oil drilling operation is conducted in a season in which ice is formed, a heating means 24 is fixed to that portion of the pipe 6 which is close to the surface of the sea-water or an ice layer 13'.

The operation of a working platform according to the present invention will be described.

When barge 10*b* receives a pressure applied thereto parallel to the surface of the sea-water due to the movement of the surrounding fast ice or floating ice during an oil drilling operation with a pipe 6 driven into the sea-bottom, the barge 10*b* is moved by a certain amount and in a certain direction which are in accordance with the amount and direction of movement of the ice. This causes first carriers 21, 21*a* to be moved along first rails 20, 20*a* by an amount equal to the amount of movement of the barge 10*b* in a direction Y, and a second carrier 23 along second rails 22, 22*a* by an amount equal to the amount of movement of the barge 10*b* in a direction Y.

The movements of the barge 10*b* in the directions X, Y can be controlled while making calculations by a computer on the basis of a signal which is representative of the amount and direction of movement of the ice and which is generated by a strain gauge attached on the outer surface of the barge 10*b*. When the movement of the ice can be measured with the eye, the movements of the barge 10*b* may be manually controlled.

That portion of the ice B′ formed in the cutout portion 19 of the barge 10*b*, which is around the pipe 6 is melted by a heating means 24 fixed to the pipe 6. Therefore, the movement of the fast ice or floating ice is absorbed by moving the barge 10*b* in accordance with the movement of the ice. In consequence, the pressure of the ice does not reach the oil drilling equipment 5*a*, particularly, the oil drilling pipe 6 so that the pipe 6 and other parts are never broken or damaged.

The size of the cut-out portion 19, and the amount of movement of the barge 10*b* in the directions X, Y are selected with reference to the amount of movement of ice in an ice covered sea area in which a working platform is installed (the amount of movement of ice in, for example, the Arctic Ocean is not more than 20 m at most in the winter season). When the amount and direction of movement of ice in an ice covered sea area in which a working platform is to be installed are already known, it is sufficient to consider the amount of movement of a barge in one direction only (for example, a direction Y).

Figure 13:
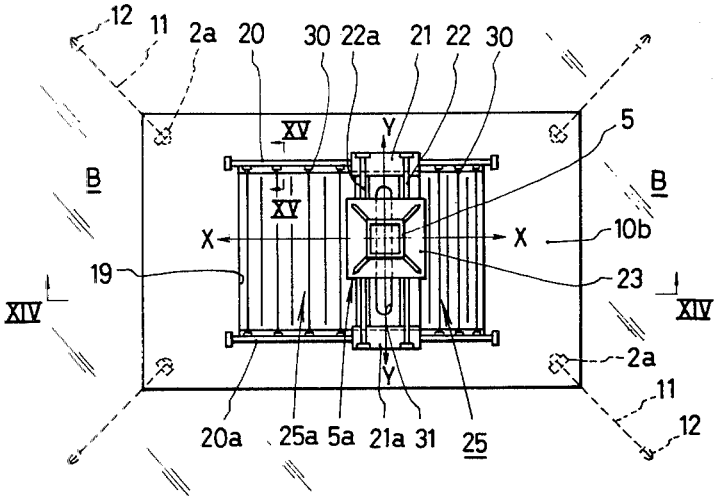
FIG. 13 is a plan view of a tenth embodiment of the present invention.
Figure 14:
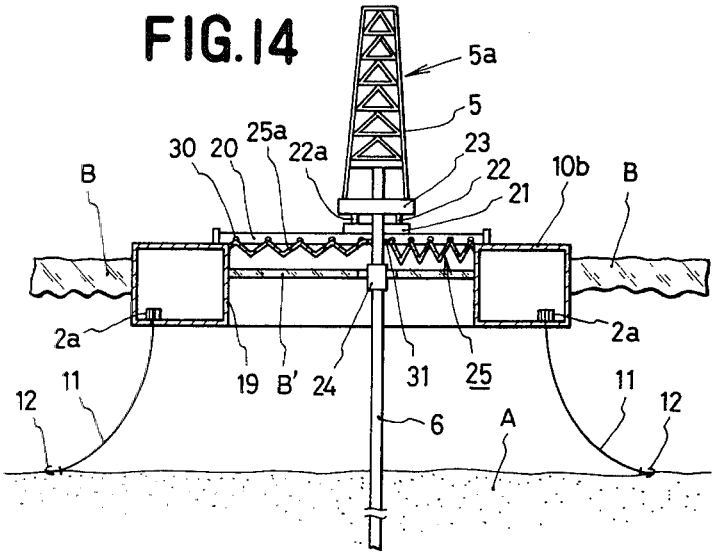
FIG. 14 is a longitudinal sectional view taken along the line XIV—XIV in FIG. 13.
Figure 15:
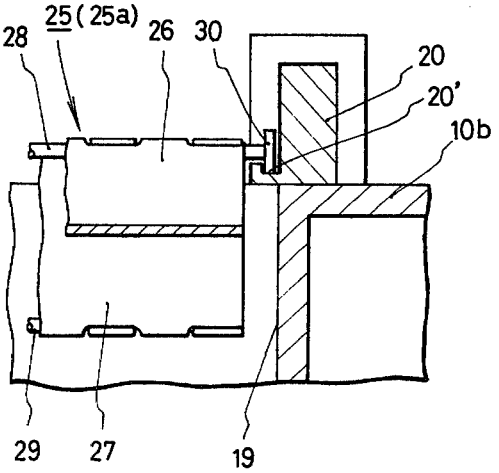
FIG. 15 is a longitudinal sectional view taken along the line XV—XV in FIG. 13.

FIGS. 13–15 show a tenth embodiment of the present invention. This embodiment is the same as the ninth embodiment except that the former is provided additionally with two hatch covers 25, 25*a* which can be utilized as decks. Each of the hatch covers 25, 25*a* consists of, for example, steel plates 26, 27 pivotally connected to shafts 28, 29; rolls 30 mounted on both end portions of higher shaft 28; and grooves 20′ provided in that side surface of each of the first rails 20, 20*a* which are on the side of the cut-out portion 19, along which grooves 20′ the rolls 30 are rotated. The hatch covers 25, 25*a* can thus be folded and unfolded in the X direction. An elongated opening 31, through which the pipe 6 is passed, is provided in that end portion of each of the hatch covers 25, 25*a* at which the hatch covers 25, 25*a* are abutted to each other.

The movement of the barge 10*b* in the X direction with respect to the pipe 6 due to the movement of the surrounding ice C is absorbed by the hatch covers 25, 25*a* being folded and unfolded in the X direction, while the movement of the barge 10*b* in the Y direction is absorbed by the elongated opening 31. In spite of the hatch covers 25, 25*a* additionally provided, the pressure of the moving ice does not reach the oil drilling equipment 5*a* including the pipe 6.

The first to eighth embodiments of the present invention shown in FIGS. 1–10 have the following effects.

(a) Since the platform 1 on which oil drilling equipment is mounted is protected by the floating ice prevention frame 10, and since elastic sheets 13, 14 or air bags 16 are laid in the space between the platform 1 and ice prevention frame 10 so as to form a space C constituting a heat-insulating layer, that portion of the surface of the sea-water in which the sheets or air bags are provided is never freezed.

Although the ice prevention frame 10 is pushed by the ice, which is formed outside the same, to be moved in the same direction as the ice, the platform 1 is never affected by the pressure of the ice since no ice or thin ice, if any, exists in that portion of the sea-water in which the sheets 13, 14 or air bags 16 are provided. Accordingly, the platform and oil drilling equipment, particularly, the oil drilling pipe 6, are never broken and an oil drilling operation can be conducted safely.

Since a distance by which the ice prevention frame 10 can be moved is determined beforehand in view of the distance by which the ice in the object sea area is moved in a season in which an oil drilling operation is to be conducted, the ice prevention frame can be prevented from being pressed against the platform during an oil drilling operation.

(b) Oil drilling equipment can be separately towed to an object sea area as it is mounted on a platform. The oil drilling equipment may be anchored to be fixed to the sea-bottom in the object sea area. An ice prevention frame and elastic sheets may also be set in the object sea area. Therefore, a working platform as a whole can be readily set up in an object place very easily in a very short period of time.

(c) All of these working platforms can be disassembled very easily in a short period of time. The disassembled working platform can be transported as it is to another object place and used there in the same manner. Therefore, a small number of working platforms can be used in many object places by turn. These working platforms pose no problem of environmental pollution after they have been removed.

(d) These working platforms can be installed in both ice covered sea areas and sea areas with no ice for conducting oil drilling operations therein, and disassembled easily after use. Therefore, the working platforms permit conducting oil drilling operations continuously in all seasons.

(e) These working platforms can be installed in ice covered sea areas of any depth and permit conducting oil drilling operations and being disassembled after use in such sea areas.

(f) These working platforms can be operated in all seasons in ice covered sea areas of any depth. They can be manufactured at a low cost and used safely. The ninth and tenth embodiments shown in FIGS. 11–15 have the following effects.

In these embodiments, the ice prevention frame in the first to eighth embodiments is replaced by a barge 10*b*, on which oil drilling equipment 5*a* is mounted. Since the oil drilling equipment 5*a* is movably supported on a carrier provided on rails 20, 20*a*, 23, 23*a*, which are supported on the barge 10*b*, the oil drilling equipment including oil drilling pipe 6 is never damaged in spite of the movement of the barge.

In these embodiments, only the oil drilling pipe 6 is passed through a cut-out portion 19 in the center of the frame type barge 10*b*. Accordingly, these embodiments are very simple in construction.

The present invention is not, of course, limited to the above-described embodiments; it may be modified in various ways within the scope of the appended claims.

What is claimed is:

1. A working platform for oil drilling operations in ice-covered sea areas, said working platform comprising a platform means floating on the surface of the sea-water, oil drilling equipment mounted on said platform means, an oil drilling pipe extending from said oil drilling equipment to the bottom of said sea, a buoyant floating frame disposed around said platform means such that said frame is spaced from said platform means, said frame enclosing the surface of the sea water surrounding said drilling pipe, wherein said frame has sufficient strength to withstand the pressure of the ice and is movable in accordance with the movements of the ice, and heat insulating means for heat insulating the surface of the sea-water inside of said floating frame and is between said frame and said platform means.

2. A working platform for oil drilling operations in ice covered sea areas according to claim 1, wherein said heat-insulating means comprises a plurality of vertically spaced sheet type materials.

3. A working platform for oil drilling operations in ice covered sea areas according to claim 1 or 2, wherein said heat-insulating means comprises a plurality of vertically spaced sheet type materials, heated air being supplied into the space formed between said sheet type materials.

4. A working platform for oil drilling operations in ice covered sea areas according to claim 1, wherein said heat-insualting means comprises a plurality of air bags.

5. A working platform for oil drilling operations in ice covered sea areas according to claim 4, wherein said air bags are provided with valves for regulating the air pressure therein.

6. A working platform for oil drilling operations in ice covered sea areas according to claim 4, wherein said air bags cover that portion of the sea-water which is between said frame and said platform means so as to prevent one of said frame and said platform means from running on the other when said frame is moved by the pressure of the ice.

7. A working platform for oil drilling operations in ice covered sea areas according to claim 1, wherein said frame and said platform means are anchored to the sea-bottom, and the distance between said frame member and said platform is kept greater than a distance by which the surrounding ice is moved during an oil drilling operation.

8. A working platform for oil drilling operations in ice covered sea areas according to claim 1, wherein said platform means contacts the sea-bottom at the lower surface thereof.

9. A working platform for oil drilling operations in ice covered sea areas accoridng to claim 1, wherein said platform means is supported on a plurality of legs.

10. A working platform for oil drilling operations in ice covered sea areas according to claim 1 wherein said frame, said platform means and said heating insulating means are formed in a circular arrangement.

11. A working platform for oil drilling operations in ice covered sea areas according to claim 6, wherein said air bags are provided with weights.

12. A working platform for oil drilling operations in ice-covered sea areas, which comprises a floating frame member, first rails provided on said frame member such that said first rails cross a space in the central portion of said frame member, second rails supported over and at right angles to said first rails such that said second rails can be moved on said first rails oil drilling equipment mounted on said second rails, and an oil drilling pipe connecting said oil drilling equipment to the sea bottom, said frame member being provided with a cover over the space in the central portion thereof, said cover being provided with an elongated opening along either said first rails or said second rails, and said oil drilling pipe being passed through said elongated opening.

13. A working platform for oil drilling operations in ice-covered sea areas, whih comprises a floating frame member, first rails provided on said frame member such that said first rails cross a space in the central portion of said frame member, second rails supported over and at right angles to said first rails such that said second rails can be moved on said first rails oil drilling equipment mounted on said second rails, and an oil drilling pipe connecting said oil drilling equipment to the sea bottom, said oil drilling pipe being provided with an ice-melting heater at a portion thereof contacting a surface portion of the sea.

* * * * *